US006127654A

United States Patent [19]

Fletcher

[11] Patent Number: 6,127,654

[45] Date of Patent: Oct. 3, 2000

[54] METHOD FOR MANUFACTURING HEATING ELEMENT

[75] Inventor: David Fletcher, Hamlin, N.Y.

[73] Assignee: Alkron Manufacturing Corporation, Rochester, N.Y.

[21] Appl. No.: 09/127,226

[22] Filed: Jul. 31, 1998

Related U.S. Application Data

[60] Provisional application No. 60/054,505, Aug. 1, 1997.

[51] Int. Cl.[7] ..... H05B 3/00; G03G 15/20

[52] U.S. Cl. ..... 219/216; 219/543; 219/469; 492/46

[58] Field of Search ..... 219/216, 270, 219/388, 543, 523, 469, 470–471, 553, 505; 355/405; 432/228, 229; 492/18, 46; 428/570; 29/611, 620; 338/306–309

[56] References Cited

U.S. PATENT DOCUMENTS

| | | | |
|---|---|---|---|
| 3,922,386 | 11/1975 | Ros | 427/223 |
| 3,973,106 | 8/1976 | Ura | 347/203 |
| 4,808,490 | 2/1989 | Tsukuda et al. | 219/553 |
| 4,857,384 | 8/1989 | Mio et al. | 47/204 R |
| 5,037,705 | 8/1991 | Weber et al. | 428/570 |
| 5,039,840 | 8/1991 | Boardman | 219/270 |
| 5,869,808 | 2/1999 | Hylberg | 219/216 |

FOREIGN PATENT DOCUMENTS

| | | |
|---|---|---|
| 3545267 | 6/1987 | Germany . |
| 3-84391 | 4/1991 | Japan . |
| 3-84392 | 4/1991 | Japan . |
| 406184722 | 7/1994 | Japan . |
| 8-227245 | 9/1996 | Japan . |

*Primary Examiner*—John A. Jeffery
*Attorney, Agent, or Firm*—Jaeckle Fleischmann & Mugel, LLP

[57] ABSTRACT

A heating apparatus and method of making such apparatus has a deposited heating element of oxidized metal powder. The metal powder is oxidized more than forty percent and preferably between sixty and ninety-five percent. The oxidation is the deposited metal powder is increased by either modifying the powder or the modifying the deposition process. The powder is modified by preoxidation, reducing the size of particles, removing oxidation inhibitors, adding oxidation catalysts and enhancers and increasing the surface area of the particles. The process of deposition is modified by using more oxygen and using a high velocity oxy-fuel plasma deposition process.

21 Claims, 6 Drawing Sheets

METHOD FOR MANUFACTURING HEATING ELEMENT

CROSS-REFERENCE TO RELATED APPLICATION

This application claims priority from Provisional Application Ser. No. 60/054,505, filed Aug. 1, 1997.

BACKGROUND

This invention relates in general to a heating apparatus and method and, more particularly, to a fusing apparatus and method for fusing toner to a copy sheet, such as paper.

In a typical photocopy apparatus, an image is projected onto the surface of a charged photoconductor. The conductor may be a selenium drum or, an organic photoconductor that is deposited on the surface of a flexible belt. The photoconductor is initially electrostatically charged. The charged photoconductor is then selectively discharged in regions exposed to the image. The remaining charged regions form a latent electrostatic image. The photoconductor passes near a supply of toner particles which are attracted to the charged, latent image. The photoconductor is then brought into proximate location with a copy sheet. The toner particles are transferred to the copy sheet by suitable transfer apparatus, typically a transfer corona, transfer roller or other alternative device. The copy sheet then passes through a thermal fusing station. The thermal fuser uses heat to partially melt and fix the toner particulars to the copy sheet. The fusing station may also use a pressure roller to assist the fusing process. A similar fusing operation occurs in laser print engines where a photoconductive member is selectively discharged by a laser to create a latent image. Such laser print engines are found in laser printers and laser facsimile machines.

Conventional fusing stations suffer from a number of drawbacks. They have a thermal fusing element such as a roller or one or more strip heaters. In both cases, the temperature of the fusing element must be held to a relatively close tolerance for successful fusing. Conventional fusing stations rely upon one or more thermistors to sense the temperature at one or more locations of the fusing elements. Suitable control and power circuitry responds to thermistor signals to adjust the temperature of the fusing element. Such control systems are expensive, complex, and unreliable. Moreover, the results of such operations, especially at high speeds, is disappointing. Indeed, only the more expensive high speed printers and copiers can afford the required overhead of components and controls in order to quickly produce numerous copies with acceptable fusing. Accordingly, there exists a long felt need in the art for a simpler, self-regulating fusing station that has fewer components and permits the user to run the fusing apparatus at a relatively high speed. This invention meets those needs.

This invention uses a heating element that is manufactured in accordance with the method of manufacture disclosed in U.S. Pat. No. 5,039,840, the entire disclosure of which is herein incorporated by reference. The referenced patent describes how a conductive material is flame spray deposited on a surface to create a heating element. During flame spraying, the metallic powders are partially oxidized to produce a resistive coating comprising a conductive oxide layer with controlled resistance. The patent applies the heating elements to electric kettles and other domestic appliances. This invention adapts the conductive oxide layers to a fusing apparatus. In particular, this invention provides a self-regulating fusing apparatus using conductive oxides. The apparatus does not require sensors or feedback networks. Instead, the conductive oxide self regulates and draws the necessary current to the heat portions of the fusing element.

SUMMARY

The invention includes a fuser for a copier and a heating apparatus and method of making such apparatus. The heating element comprises oxidized metal powder. The metal powder is oxidized more than forty percent and preferably between sixty and ninety-five percent. The oxidation in the deposited metal powder is increased by either modifying the powder or the modifying the deposition process. The powder is modified by preoxidation, reducing the size of particles, removing oxidation inhibitors, adding oxidation catalysts and enhancers and increasing the surface area of the particles. The process of deposition is modified by using more oxygen and using a high velocity oxy-fuel plasma deposition process.

DETAILED DESCRIPTION

Figure 1B:
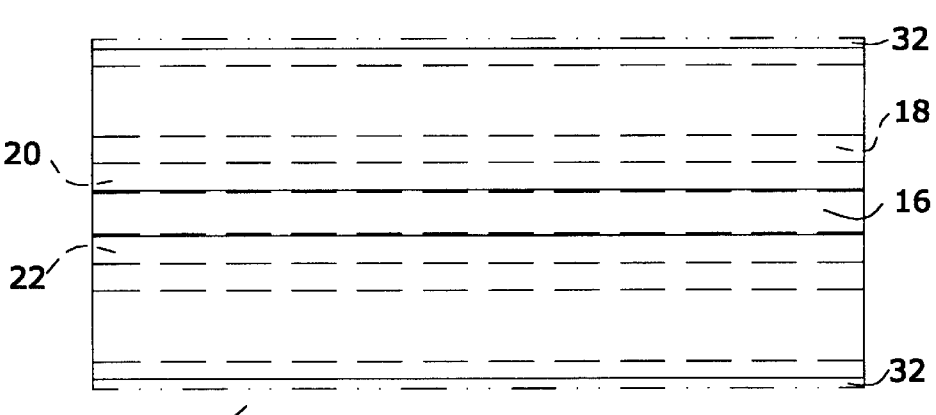
FIGS. 1A, 1B are views of a first embodiment of the invention.
Figure 1A:
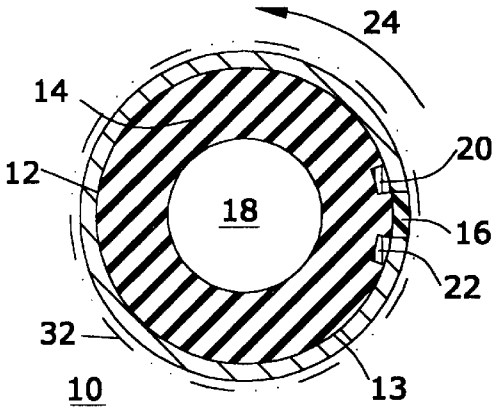

A first embodiment of the invention incorporated into a fusing roller is shown in FIGS. 1A, 11B. A fusing roller 10 compromises an annular dielectric roller 14 with a resistive coating 12 is deposited on the outer cylindrical surface 13 of the dielectric roller 14. The conductive resistive coating 12 covers nearly the entire outer surface 13 of the dielectric roller 14. A thermally conductive, insulating strip 16 separates the ends of the conductive layer 12 from each other. The ends of the conductive layer 12 adjacent strip 16 are attached to conductors 20, 22, respectively. Electrical power is supplied to those conductors and electricity is conducted through conductive oxide layer 12 between conductors 20, 22. The electrical current travels in the direction indicated by the arrow 24. A release material 32 is coated on the surface of the conductive oxide layer 12. The release material 32 may be any suitable material such as polytetrafluoroethylene. The release material is especially designed to release toner particles so that they do not stick to the fusing roller 10. The bore 18 of the roller is mounted on suitable bearings for turning within a copier machine or a printer.

Figure 2B:
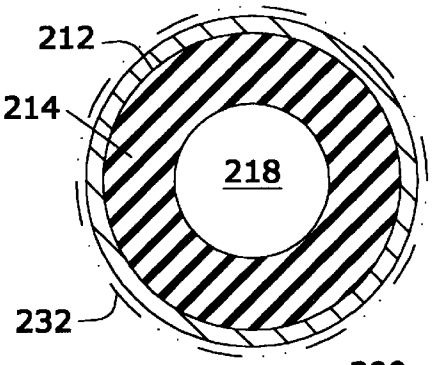
FIGS. 2A, 2B are views of a second embodiment of the invention.
Figure 2A:
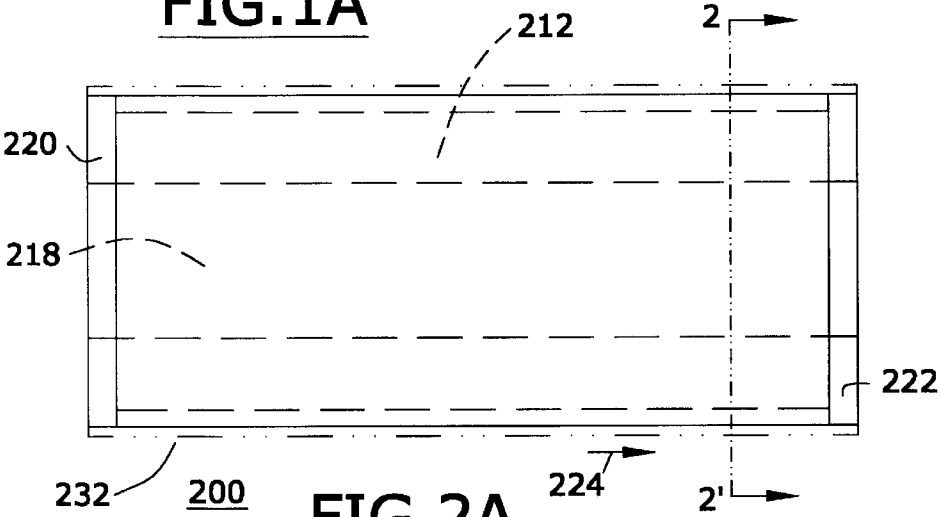

A second roller embodiment of the fusing apparatus is shown in FIGS. 2A, 2B. The roller 200 has conductors 220, 222 disposed on opposite ends. Electrical current travels from one conductor to another through the conductive oxide layer 212. The direction of the current is shown by arrow 224. Roller 200 also has an outer release layer 232 of polytetrafluoroethylene.

Figure 3A:
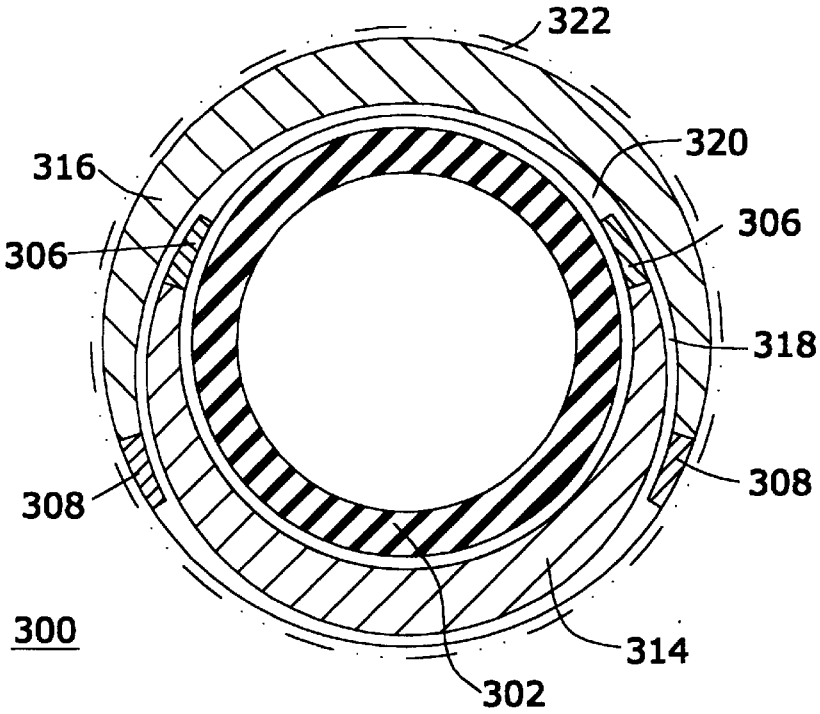
FIGS. 3A, 3B are views of a third embodiment of the invention.

Turning to FIG. 3*a*, a third embodiment of the fusing apparatus 300 is shown. Apparatus 300 has a bore 302 covered by a first dielectric material 318. Upon portions of first dielectric material 318 are at least one set of conductivity strips 306, a first resistive coating 314, and a second dielectric layer 320. Overlaying a portion of second dielectric layer 320 is a second resistive coating 316. A portion of second resistive coating 316 is overlaid by a second set of conductivity strips 308 wherein a release material 322 overlays strips 308 and coating 316. Release material 322 also overlays the portions of second dielectric material 320 and first resistive coating 314 not already overlaid with another material or layer.

Figure 3B:
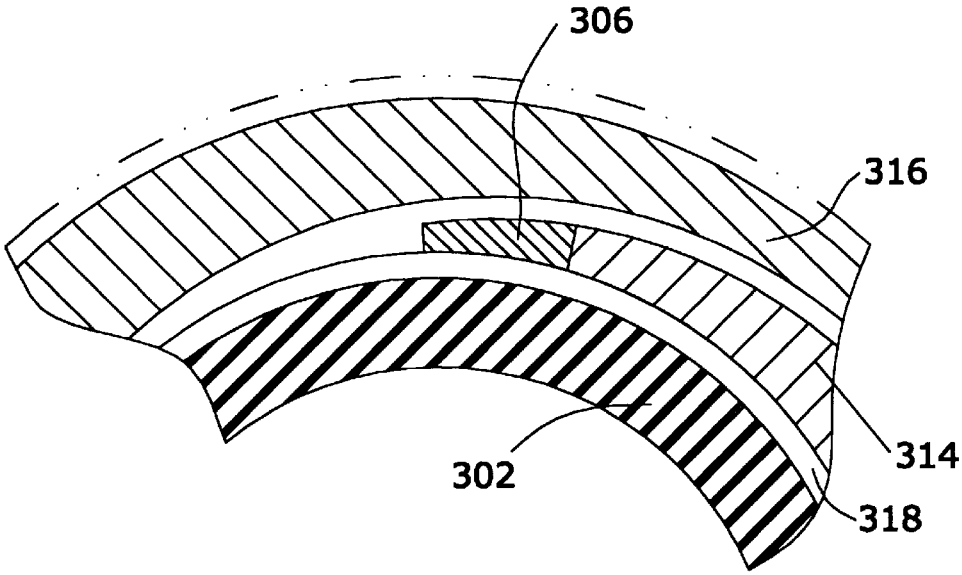

As illustrated in FIG. 3*b*, an enlarged view of FIG. 3*a* taken from box 3, conductive strip 306 interconnects with the proximal end of first resistive coating 314. Returning to FIG. 3*a*, the terminal end of first resistive coating 314 interconnects with the other conductive strip 306. Likewise, second resistive coating 316 interconnects with the second set of conductive strips 308 not shown. Preferably, coatings 314 and 316 should overlap each other as illustrated in FIG. 3*b*.

Figure 4:
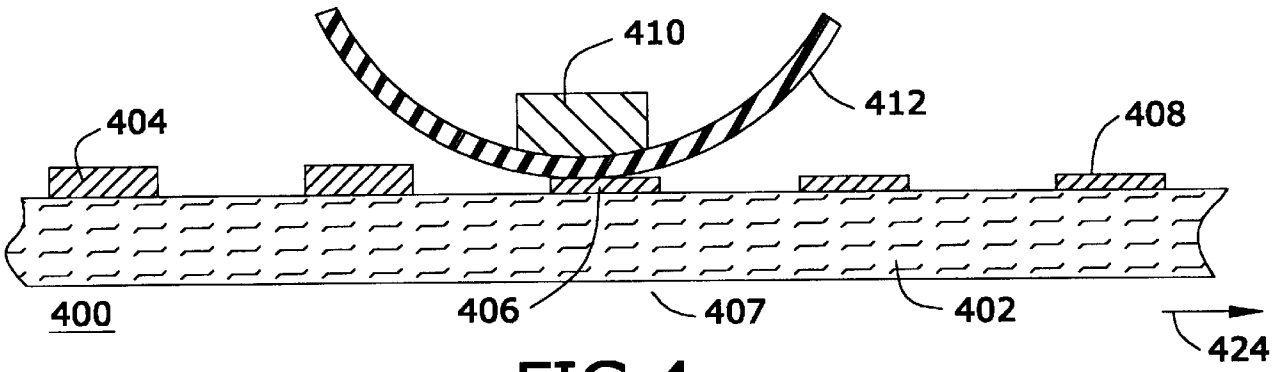
FIG. 4 shows an embodiment of the invention as a strip heater.

As shown in FIG. 4, a strip heater 410 including the invention provides a fusing operation. The apparatus 400 has a flexible fusing belt 412 of polyimide material that passes between a strip heater 410 and a copy sheet 402. The copy sheet 402 travels in the direction indicated by the arrow 424. Copy sheet 402 has unfused toner 404 on one end and fused toner 408 on the other end. At fusing station 407 the copy sheet 402 comes into close proximity with the heated fusing belt 412 and the strip heater 410 where the toner 404 is partially melted and fixed to the copy sheet 402. Pressure rollers (optional, not shown) at fusing station 407 assist in fixing the toner 404 to the copy sheet 402.

Figure 5B:
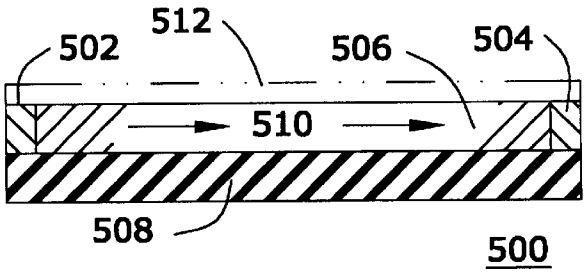
FIGS. 5A, 5B show a first embodiment of a strip heater using the invention.
Figure 5A:
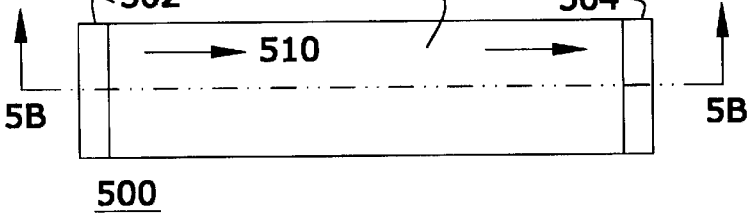

Another strip heater embodiment is shown in FIGS. 5A, 5B. Elongated strip heater 500 has a pair of conductors 502, 504 disposed at opposite ends. Electrical current 510 travels in the direction indicated by the arrows 510 and passes through the conductive oxide material 506 that has been flame spray deposited upon a suitable substrate 508. The strip heater 500 may also have a release coating or lubricious coating 512 on the surface that faces the thermal fusing belt 412. A typical lubricious coating is polytetrafluoroethylene.

Figure 6B:
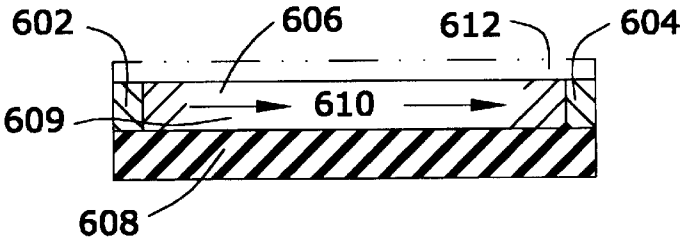
FIGS. 6A, 6B show a second embodiment of the invention as a strip heater wherein 6B is an enlarged cross-section view taken along the line 6—6' of FIG. 6A.
Figure 6A:
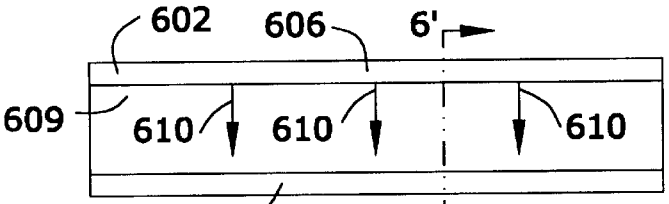

A third strip heater embodiment is shown in FIG. 6A, 6B. The strip heater 600 has a pair of conductors 602, 604. Resistive coating 609 is flame sprayed deposited or otherwise suitably formed onto a suitable substrate 608. Current flows in the direction indicated by arrows 610 from one conductor 602 to the other conductor 604. Power is supplied to the conductors 602, 604 in a manner well known to those skilled in the art. The strip heater 600 is covered with a lubricious surface coating 612.

The strip heater embodiments 500, 600 may be used singly or in combination. As shown in FIG. 6C, a number of strip heaters 600.1, 600.2, 600.3 . . . 600.n are shown proximate a fusing belt 640. Fusing belt 640 is typically a polyimide material. Belt 640 travels in the direction indicated by arrow 650. In operation, the strip heaters 600.1–600.*n*have resistive coatings that decrease in resistance from strip heater 600.1 to strip heater 600.*n*. Accordingly, as the belt 640 travels its endless path, it passes over strip heaters whose temperature gradually increases to a maximum at strip heater 600.1. At that location the copy sheet is brought into close proximity with the fusing belt 640 and the fuser material is fixed to the copy sheet.

Figure 6D:
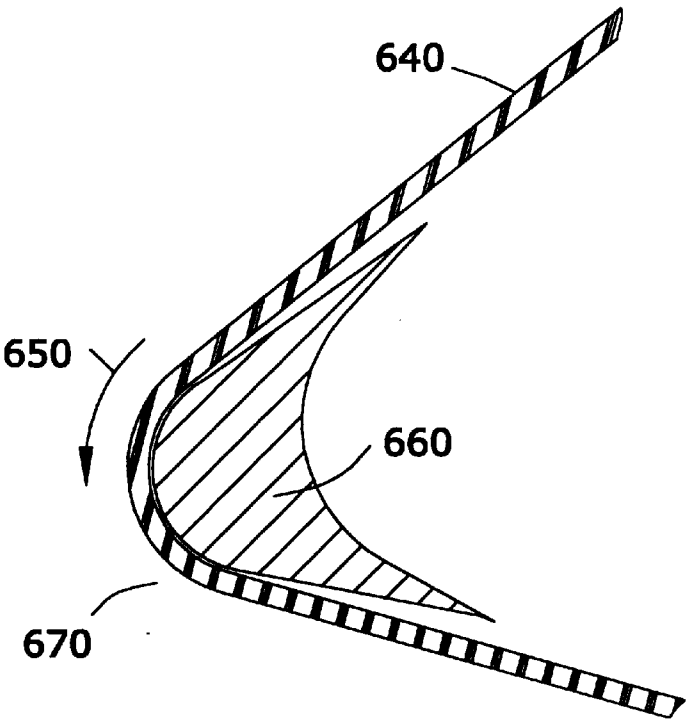
FIGS. 6C, 6D show embodiment of the invention for heating a flexible photoconductor.
Figure 6C:
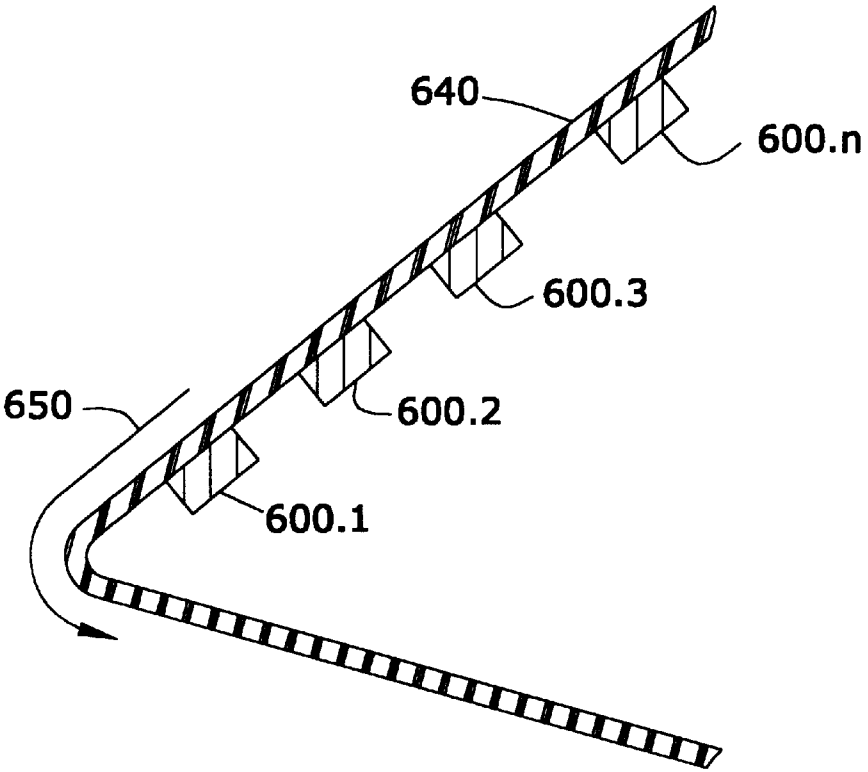

Another embodiment of the invention is shown in FIG. 6D. The strip heater 660 is specially shaped to be relatively thin at the leading and trailing edges proximate the fusing station 670 and relatively thick across the major portion of the fusing station. Strip heater 660 has a resistive coating on its surface facing the belt 640. By varying the shape and thickness of the strip heater 660, one can establish a temperature gradient that gradually increases to a maximum over the fusing station.

The single or multiple strip heaters shown in FIGS. 6A–6D overcome the problem of regulating the temperature of prior art fusing stations. Their temperature is monitored and adjusted in accordance with the width of the copy sheet. When an envelope passes through a conventional fuser, the envelope draws heat out of the fuser in the region through which the envelope passes and that region's temperature drops. The regions adjacent to the passing envelope maintain a relatively constant temperature. In order to keep the entire fuser at the same operating temperature, conventional fusers require sensors to detect where an envelope passes through the fuser. With the invention, the conductive oxide regulates the temperature. In other words, as an envelope passes across the strip heater 600, the conductive oxide resistive coating in that region draws more current to replace the heat absorbed by the envelope. However, no additional current is required in the regions adjacent to the envelope. As such, the invention does not require segmenting the conductors to provide heat to some areas and not to others.

Figure 7B:
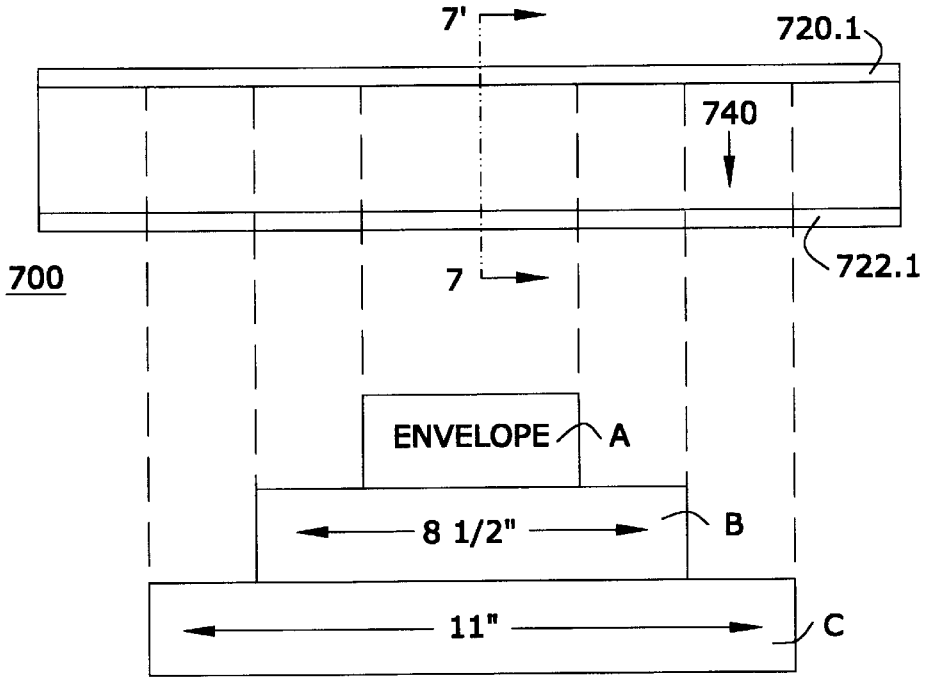
FIGS. 7A, 7B show a strip heater embodiment having multiple resistant heater layers.
Figure 7A:
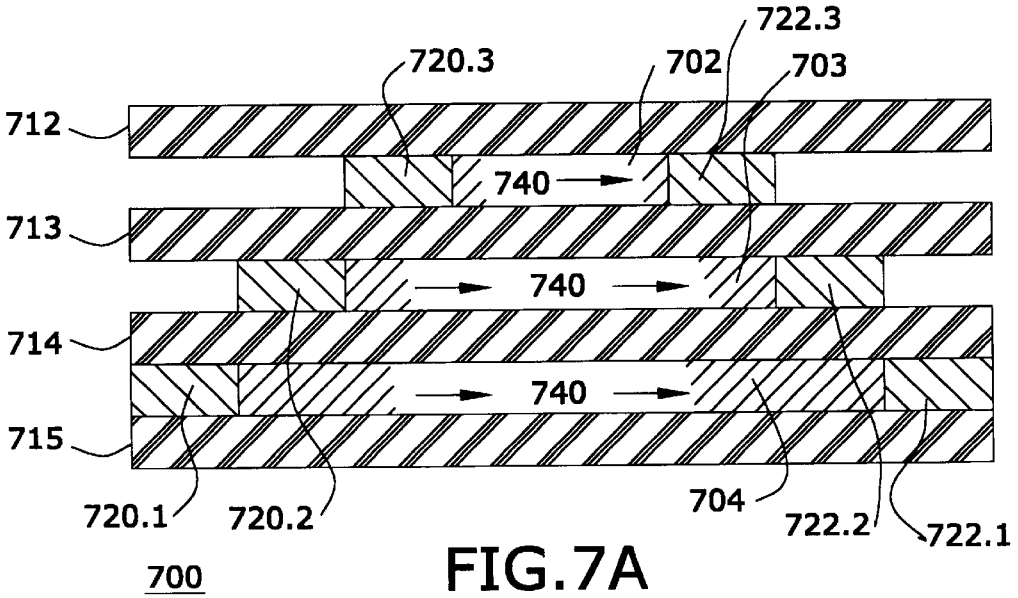

The invention can also provide multiple heating layers to heat the fusing station to an optimum temperature. Turning to FIGS. 7A, 7B, there is shown a strip heater 700 that has three conductive oxide resistive coating heating elements 702, 703, 704. Current flows from conductor 720.1, 720.2, 720.3 to, respectively, conductors 722.1 722.2, 720.3 in the direction shown by arrow 740. The heating elements are separated insulated and from each other by dielectric layers 712, 713, 714, 715. Electrical currents in resistive coatings 702, 703, and 704 flow in the same direction 740 between their respective conductors. Other dielectric (not shown) material fills the space between dielectric layers 712, 714 and between the edge of the strip heater 700 and the respective conductors (not shown) disposed on opposite ends of the conductive oxide layers not shown. The resistive coating 702 is wide enough to heat a region corresponding to the width of an envelope. The resistive coating 703 is at least 8½" wide in order to fuse a copy sheet having a width of 8½". Resistive coating 704 is approximately 11"wide to accommodate substantially any size paper including legal size paper (14"×11"). Those skilled in the art will appreciate that the resistive coating heating elements may be made to any suitable width to accommodate the width of a copy sheet that passes transverse to the oxide layer. In operation, the conductive oxide heating elements are operated either singly or in combination with one or more resistive coating heating elements in order to suitably fuse toner to copy material passing the strip heater.

Figure 8A:
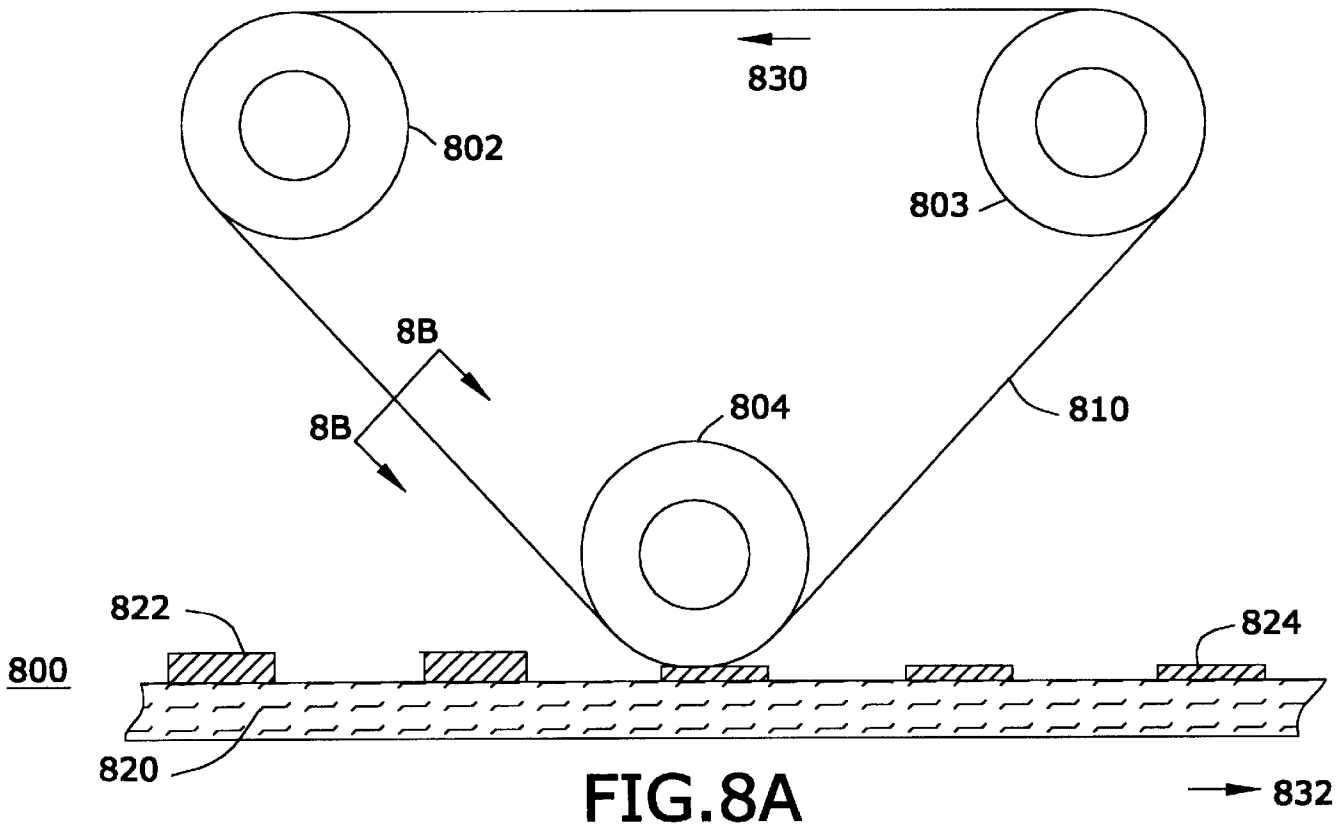
FIGS. 8A, 8B show a fusing apparatus with a flexible, heated belt.
Figure 8B:
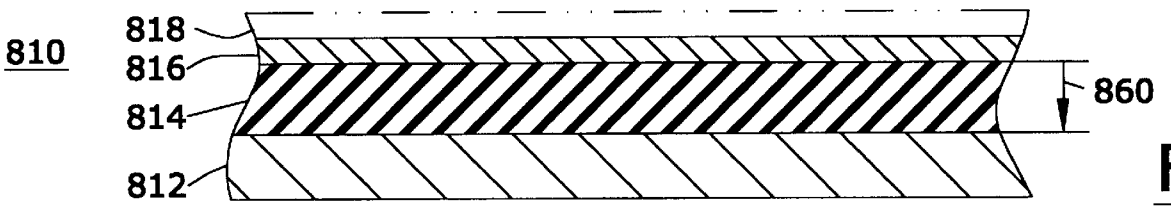

FIGS. 8A, 8B illustrate still another embodiment of the invention. The prior embodiments of FIGS. 4–7 relied upon transferring heat from a strip heater to a thermally conductive fusing belt. The embodiment of FIGS. 8A, 8B incorporates the resistive coating directly into a flexible fusing belt 810 that travels around an endless path defined by rollers 802, 803, 804. A copy sheet 820 has unfused toner 822 on one end and fused toner 824 on the other. The fusing belt 810 travels the path indicated by arrow 830; the copy sheet 820 travels in the direction indicated by arrow 832. The fusing belt has a flexible metal substrate 812 of any suitable metal such as steel or stainless steel. A resistive coating 814 is deposited onto the flexible metal substrate 812. A conductive material 816 is deposited on the resistive coating 814 in a conventional manner well known to those skilled in the art. Finally, a release layer 818 is deposited on the conductive layer 816. Electrical energy is supplied to the resistive coating 814 via the flexible metal belt 812 and the conductive layer 816. Electrical current generally flows in the direction indicated by arrow 860.

In addition to the above improvements, the invention includes a further discovery that a conductive oxide layer may be formed using metallic powders that are pre-oxidized. In U.S. Pat. No. 5,039,840 dry metal powders are heated during flame spraying and are partially oxidized. It is believed that this method results in a relatively uncontrolled amount of oxidation of the metal powders. As an improvement, this invention preoxidizes metal powders in a controlled oxidation reaction. The pre-oxidized metal powder is flame spray deposited on a substrate. The more uniformly oxidized metal powders result in a heating element that provides a more uniform temperature for a given thickness and a given current.

I found that it is necessary that the layer comprise more than forty percent (40%) oxidized particles and preferably more than sixty percent (60%). Depending upon the particular heating application, the particles could be oxidized as much as ninety-five percent (95%) The deposited layer may have one or more regions of powders oxidized at different percentages. Other layers may include graded regions of variable oxidation. As such, the temperature experienced by a copy sheet could vary in stages or gradually along its passage through a fuser using a heating element of the invention.

Increasing the oxidation of metal powders is contrary to conventional deposition techniques. Most techniques inhibit or reduce oxidation. Many perform deposition in a vacuum to entirely prevent oxidation. Other techniques minimize the surface area or coat the surface of the metal powders with an oxidation inhibitor.

Subsequent experiments found that metal powder flame sprayed in accordance with the process described in U.S. Pat. No. 5,039,840 result in a layer of powder metal that is about forty percent (40%) oxidized. Tests showed that such layers perform poorly as heating elements. Further tests showed that increasing the oxidation of the metal powders substantially improved their performance as heating elements, especially where the current path was relatively short. The oxidation of the deposited metal powders can be increased by preoxidizing the powders or by increasing the oxidation of the powders during deposition. Oxidation during deposition is increased by fabricating the metal powders to have a larger surface area, smaller particle size, removing conventional oxidation inhibitors from the powders, and by adding oxidation catalysts and enhancers to the powders. One may also use different deposition techniques that enhance the oxidation of the powders. One such technique is high velocity oxy-fuel (HVOF) plasma deposition. That process uses a mixture of hydrogen and oxygen or a mixture of propylene and oxygen for plasma deposition of metal powders. The metal powder used for the heating layer is an alloy of nickel and chromium, commonly called Nichrome. The Nichrome alloy is oxidized at least 40%. The resulting layer is a conductive and resistive layer that generates enough heat to fuse toner to a copy sheet.

Having thus described the several embodiments of this invention, those skilled in the art will appreciate that changes, additions, deletions and alterations of the above embodiments are deemed within the spirit and scope of the invention.

What is claimed is:

1. A heating element comprising a substrate with-a deposited heating element for generating thermal output energy from input electrical energy, said heating element comprising a layer of metal powders, wherein at least about 60% of the metal in the layer is a conductive, resistive oxide.

2. The heating element of claim 1 wherein the metal layer comprises two or more regions of different percentages of oxidation.

3. The heating element of claim 1 wherein the metal layer comprises a region of variable oxidation.

4. The heating element of claim 1 wherein the metal is an alloy of nickel and oxidized more than 40%.

5. The heating element of claim 1 wherein the substrate is a cylindrical roller with a pair of electrical conductors disposed adjacent each other, connected to the conductive, resistive layer and extending along the height of the cylinder for creating a current path along the circumference of the cylinder between the two electrodes.

6. The heating element of claim 1 further comprising a second layer of metal powders wherein more than 40% of the layer is a conductive, resistive oxide, the two layers partially overlapping each other, separated from each other by a dielectric and each having a pair of electrical conductors extending along the height of the cylinder and located at opposite ends of the conductive resistive layers for creating a current path along the circumference of each of the layers.

7. The heating element of claim 1 wherein the substrate is a cylindrical roller with a pair of electrical conductors at opposite ends of the cylinder, each connected to the conductive, resistive layer and each extending around the circumference of the cylinder for creating a current path along the height of the cylinder.

8. The heating element of claim 1 wherein the substrate is elongated and has a pair of electrical conductors disposed at opposite ends for creating a current path through the conductive, resistive oxide.

9. The heating element of claim 8 wherein the elongated substrate has a flat or a curved surface.

10. The fusing station of claim 8 wherein the heating element the elongated substrate has a flat or a curved surface.

11. In an image reproduction apparatus having a fusing station where toner is fused to a copy sheet by bringing the copy sheet into proximity or contact with a heated surface of the fusing station, said fusing station comprising:

a substrate with a deposited heating element for generating thermal output energy from input electrical energy comprising a layer of metal powders wherein more than 40% of the metal is a conductive, oxide.

12. The image reproduction apparatus of claim 11 wherein at least 60% of the metal in the layer is a conductive, resistive oxide.

13. The image reproduction apparatus of claim 11 wherein the metal in the layer is a conductive, resistive oxide.

14. The image reproduction apparatus claim 11 wherein the metal layer comprises two or more regions of different oxidation.

15. The image reproduction apparatus claim 11 wherein the metal layer a region of variable oxidation.

16. The fusing station of claim 11 wherein the layer of metal powders comprises an alloy of nickel and chromium oxidized more than 40%.

17. The fusing station of claim 11 wherein the heating element the substrate is a cylindrical roller with a pair of electrical conductors disposed adjacent each other, connected to the conductive, resistive layer and extending along the height of the cylinder for creating a current path along the circumference of the cylinder between the two electrodes.

18. The fusing station of claim 11 wherein the heating element further comprises a second layer of metal powders wherein more than 40% of the layer is a conductive, resistive oxide, the two layer partially overlapping each other, separated from each other by a dielectric and each having a pair of electrical conductors extending along the height of the cylinder and located at opposite ends of the conductive resistive layers for creating a current path along the circumference of each of the layers.

19. The fusing station of claim 11 wherein the heating element comprises a cylindrical roller with a pair of electrical conductors at opposite ends of the cylinder, each connected to the conductive, resistive layer and each extending around the circumference of the cylinder for creating a current path along the height of the cylinder.

20. The fusing station of claim 11 wherein the heating element comprises an elongated substrate with a pair of electrical conductors disposed at opposite ends for creating a current path through the conductive, resistive oxide.

21. The fusing station of claim 20 comprising two or more heating elements aligned with each other along the path of the copy sheet.

* * * * *